United States Patent [19]

Poland

[11] 4,285,403

[45] Aug. 25, 1981

[54] EXPLOSIVE FIRE EXTINGUISHER

[76] Inventor: Cedric M. Poland, 1850 Carter Dr., Reno, Nev. 89509

[21] Appl. No.: 92,744

[22] Filed: Nov. 9, 1979

[51] Int. Cl.[3] ..... A62C 35/02

[52] U.S. Cl. ..... 169/28; 102/367; 169/36

[58] Field of Search ..... 169/14, 26, 27, 28, 169/30, 36, 58, 71, 74, 78, 81, 83, 84, 89; 102/6, 66, 90, 272, 273

[56] References Cited

U.S. PATENT DOCUMENTS

| | | | |
|---|---|---|---|
| 655,599 | 8/1900 | Braunwalder | 169/36 |
| 750,416 | 1/1904 | Walrath | 169/28 |
| 764,763 | 7/1904 | Pierce | 169/28 |
| 767,902 | 8/1904 | Libbey | 169/28 |
| 1,453,091 | 4/1923 | Delbare | 169/28 |
| 2,703,527 | 3/1955 | Hansen | 102/6 |
| 3,961,669 | 6/1976 | Kancko | 169/74 X |

FOREIGN PATENT DOCUMENTS

| | | | |
|---|---|---|---|
| 298498 | 4/1915 | Fed. Rep. of Germany | 102/90 |

*Primary Examiner*—Robert J. Spar
*Assistant Examiner*—Fred A. Silverberg
*Attorney, Agent, or Firm*—Lothrop & West

[57] ABSTRACT

A waterproofed explosive charge is suspended within a frangible, spherical shell containing an aqueous solution. The assembly is dropped from an airplane or helicopter towards a fire below. Either a shock-actuated percussion cap or a fuse-ignited detonation cap activates the explosive charge at the appropriate moment and the resultant explosion creates a vapor-like fog. A portion of the combustion-supporting oxygen is displaced by the fog droplets. The minute water droplets also absorb heat energy, thereby lowering surrounding air and fuel temperatures. These effects, coupled with the concussive shock wave, act to snuff the fire.

3 Claims, 4 Drawing Figures

EXPLOSIVE FIRE EXTINGUISHER

CROSS-REFERENCES TO RELATED APPLICATION, IF ANY

None.

BACKGROUND OF THE INVENTION

The invention relates to fire extinguishers using an explosive charge to disperse a fire quenching solution. The prior art discloses a number of devices in which an explosive cartridge or the like is placed within an extinguishing medium.

Pierce U.S. Pat. No. 764,763 illustrates an early approach towards such a device where a waterproof cartridge shield intrudes into a holder containing an extinguishing agent. Owing to the construction of the Pierce device, the cartridge shield consumes a considerable portion of the holder's volumetric capacity, reducing its fire quenching ability. Furthermore, the shape and placement of the cartridge shield permit the brunt of the explosive thrust to take the path of least resistance and expel through the fuse inlet aperture. Thus, the substantially non-compressible aqueous solution around the shield will not be dispersed either as widely or in such a uniform pattern as may be desired to achieve optimum results.

The patent to J. H. Walrath, U.S. Pat. No. 750,416, displays the same disadvantages pointed out in the Pierce design, but uses a dry extinguishing powder rather than the aqueous extinguishing solution used in the present invention.

There is, in other words, considerable room for improvement.

SUMMARY OF THE INVENTION

The construction and operation of the present invention is directed towards an apparatus which, upon detonation, will produce a cloud of atomized fluid droplets. The aim is not only to disperse a given quantity of fire extinguishing fluid, but also to transform the fluid into a vapor form which will squelch a fire more effectively than the direct application of large fluid droplets. In contrast to known prior art, the present invention uses a spherical, encased, explosive charge suspended centrally within a larger spherical shell confining a fluid extinguishing agent which surrounds the spherical charge. The centrally located explosive charge is held in place by radial, outwardly extending spider arms attached to the inner wall of the enclosing spherical shell.

Several arrangements for detonating the inner spherical charge are disclosed. One utilizes a thin, water proof conduit, extending from the spherical charge through the fluid and then through the spherical shell, the conduit housing a fuse for igniting the charge. In an alternative construction, a pressure sensitive piston in communication with the encased fluid cooperates with a firing pin and a percussion cap to provide a pressure-derived means for activating the charge upon the shell's jarring contact with another object. Depending on the particular application of the disclosed invention, the various detonation means may be used alone or in combination.

Upon explosion, the spherical charge exerts pressure outwardly and equally upon the surrounding fluid, resulting in a generally spherical distribution of finely divided fog droplets. Dramatic instantaneous cooling of the affected area results, lowering the temperature of fire supporting oxygen and combustible material. Also, a portion of the oxygen within the area is physically displaced by the fog droplets. The explosive creation of the vapor cloud augments the fire snuffing process, the concussive shock wave having a shattering effect upon conflagrations as is well known to oil and gas well firefighters. In summary, the cooling, oxygen displacement, and detonation wave effects created by the present invention all cooperate to extinguish the subject fire in a most effective manner.

Thus, it is an object of the present invention to extinguish fires through the concussive creation of a generally spherical fog-like atmosphere of finely divided fluid.

It is another object to provide a concussive-type fire extinguisher capable of being deposited on fires from aircraft or other airborne means.

It is yet another object to provide direct ignition as well as shock actuated means for detonating the concussive-type fire extinguishers of the present design.

These and other objects and advantages of the present invention will be disclosed in the drawings and detailed description to follow.

DETAILED DESCRIPTION OF THE PREFERRED EMBODIMENT

Figure 1:
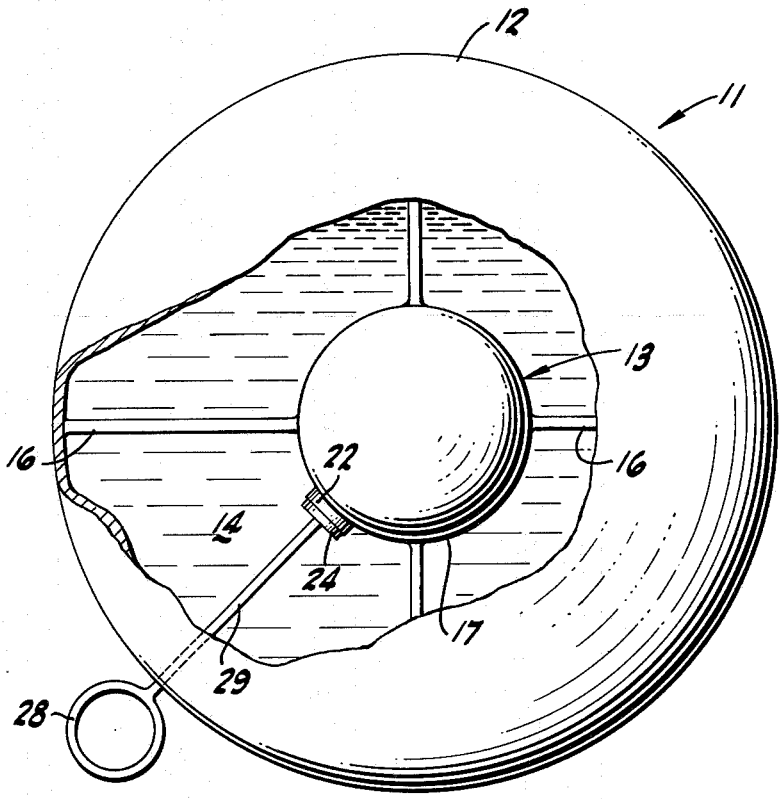
FIG. 1 is an elevational view partially cut-away to show the case of the inner spherical charge and its support arms radially extending to the outer spherical shell, the safety closure plug being shown in closed safety position.

Turning now to FIG. 1, the invention 11 generally comprises a frangible, outer shell 12 containing an inner spherical charge 13 surrounded by an aqueous solution 14. The outer shell 12 is made from a material, such as a pliable plastic, which is breakable when subjected to considerable impact forces, yet durable enough to withstand normal handling stresses. A plurality of support legs 16 extends radially outwardly from the central spherical charge 13 to the inner surface of the outer shell 12. The spherical charge 13 is thus centrally suspended within outer shell 12 and enclosed by a substantially equal measure of solution 14 on all sides.

Figure 2:
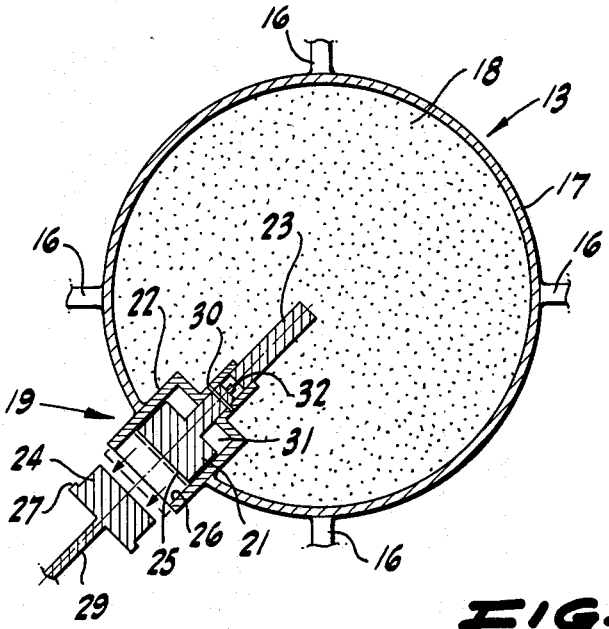
FIG. 2 is a cross-sectional view, taken to an enlarged scale, of the inner spherical charge disclosed in FIG. 1, the safety closure plug being shown in its withdrawn or operative, position.

The internal construction of the spherical charge 13 is most clearly revealed in FIG. 2. A charge encasement 17 contains an explosive charge 18 and protects it from contact with the aqueous solution 14. A shock-actuated detonator 19 penetrates the encasement 17 but a waterproof seal is nevertheless maintained.

The detonator 19 includes a piston 21, hollow cylinder 22, and percussion cap 23. In its safety position, a closure member 24 fits snugly within a conjugate aperture 26, or bore, defined by the adjacent protruding end of the cylinder 22. As shown in FIG. 1, the closure member 24 and flange-like lip 27 effectively seal aperture 26 and thereby isolate piston 21 from reacting to any pressure increases within the outer shell 12 filled with aqueous solution 14. During transport and normal handling of the invention 11, detonation of spherical charge 13 is thus precluded. A transverse shear pin 30 through the piston 21 prevents any translational movement of the piston and provides an additional safety measure against premature detonation.

The fire extinguisher of the invention 11 is particularly effective when dropped upon a spot fire or on a fire line from an elevated position, such as from an airplane or helicopter. Since the spherical outer shell 12 has no "preferred" attitude, no particular care must be exercised in orienting the device before it is dropped. Just before the device 11 is dropped, however, closure member 24 must be removed, to ensure that detonation will occur upon contact of the outer shell 13 with the ground or any object, such as a burning tree. Interconnected pull ring 28, connecting cord 29, or rod, and closure member 24 are manually withdrawn from spherical charge 13. FIG. 2 shows closure member 24 and connecting cord 29 in a withdrawn position, exposing the outer head 25 of the piston 21 to the aqueous solution 14. The device is thus armed and can be dropped in the desired direction, towards the fire to be extinguished.

Piston 21 is slidably positioned within the cylinder 22 yet the seal between the two is sufficiently tight to prevent the aqueous solution 14 from entering into air chamber 31 as the device descends. Upon encountering the ground or an object below, the outer shell 12 is subjected to very large impact forces which displace the generally non-compressible aqueous solution 14. The air contained within the air chamber 31 is compressible, however, and offers the path of least resistance for pressure impressed upon the large head end 25 of the piston 21. The piston 21 is thereby urged with great speed and force inwardly towards air chamber 31 and percussion cap 21, the shear pin 30 being severed by the sudden force as the piston 21 slides inwardly.

A firing pin 32, positioned upon the inward extremity of the piston 21, is translated into abrupt contact with percussion cap 23, thus igniting the explosive charge 18. Owing to the spherical shape of the charge encasement 17, the outwardly expanding forces generated by the explosion are exerted uniformly throughout a spherical field.

The uniformity of explosive force, coupled with the spherical shape of the confined aqueous solution, produces a generally spherical distribution of finely divided droplets of aqueous solution 14. The pattern that the fog of droplets actually assumes can be distorted by surrounding objects, but these objects are thereby assured of receiving an adequate blast of cooling droplets. The aqueous body 14 can include, in solution, fire retardant chemicals such as halides or borates to bolster the fire quenching capabilities of the device.

A number of factors act jointly to extinguish a fire subjected to the explosive blast. First, the droplets efficiently cool both the combustible materials and surrounding air below the ignition point. Second, fire retardant chemicals, contained within the droplets and mixed with the aqueous solution 14, serve to inhibit further burning. Third, oxygen necessary for support of combustion is displaced by the outwardly expanding cloud of moisture vapor and fine droplets. Lastly, the concussive forces from the blast act suddenly to snuff the fire.

While none of these extinguishing effects individually is particularly new, the cumulative manner in which the device produces the desired result does represent a new and significant advance in the art.

Having explained one preferred form of the invention 11, a variant embodiment will now be discussed, the alternative arrangement for detonating the explosive charge 18 being illustrated in FIGS. 3 and 4.

Fuse ignition of the charge 18 may be desirable if the device is placed in an area where it is to detonate automatically should flames erupt in close proximity. For instance, remote or rarely visited storage areas and mine shafts would be ideal applications for an automatic fuse ignition version of the device. Thus, while the shock-actuated detonator heretofore described is particularly useful for aerial bombing, a fuse ignition type of detonator affords unique advantages in attacking fires whose presence is unknown.

A heat-resistant tube or conduit 33 extends between an interior portion of the charge encasement 17 and the frangible outer shell 12. A registering aperture in the outer shell 12 permits a plurality of fuse threads 34, impregnated with an appropriate burning chemical, to enter the outer extremity of conduit 33. A fast-burning chemical 36 within the conduit 33 extends from the relatively slow burning fuse threads 34 to a heat-activated detonator cap 37. In operation, the fuse threads 34 are ignited by a contiguous fire, spreading ignition to chemical 36, thence to detonator cap 37, which activates. Explosive charge 18 then detonates, the operation then being identical to that previously explained.

Owing to the slender transverse dimension of the conduit 33, little force of the explosion will be lost to the outside. Thus, the efficient, generally spherical distribution of the finely particularized droplets will be maintained by this alternative detonation means.

Figure 3:
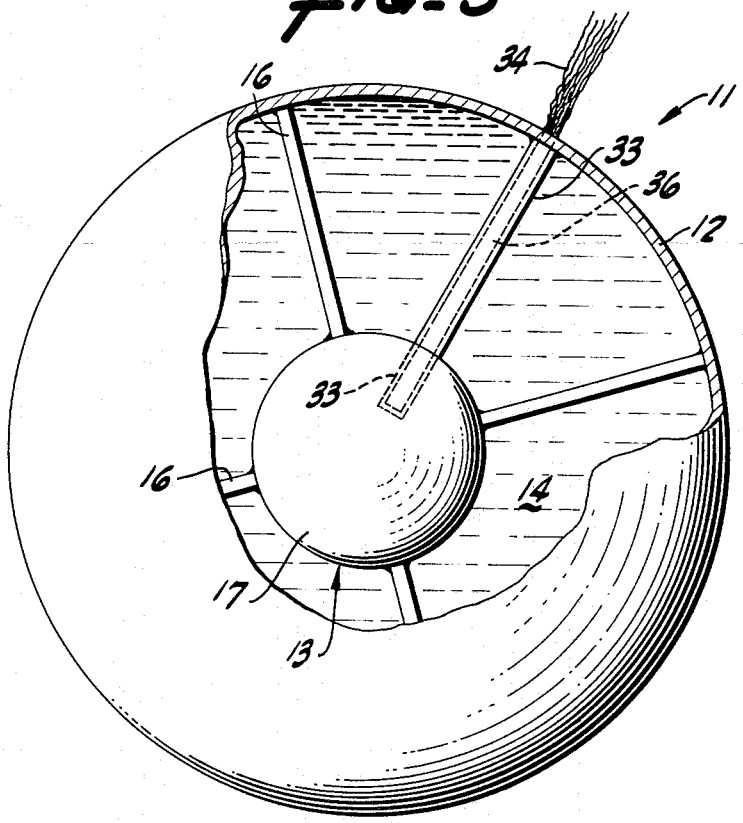
FIG. 3 is an elevational view partially cut-away and showing an alternative embodiment of the detonation means, including an ignition fuse, a waterproof conduit, and a detonation cap; and, FIG. 4 is a cross-sectional view, taken to an enlarged scale, of the inner spherical charge disclosed in FIG. 3, showing the intrusion of the conduit into the spherical charge and the conduit's connection to the internal detonation cap.
Figure 4:
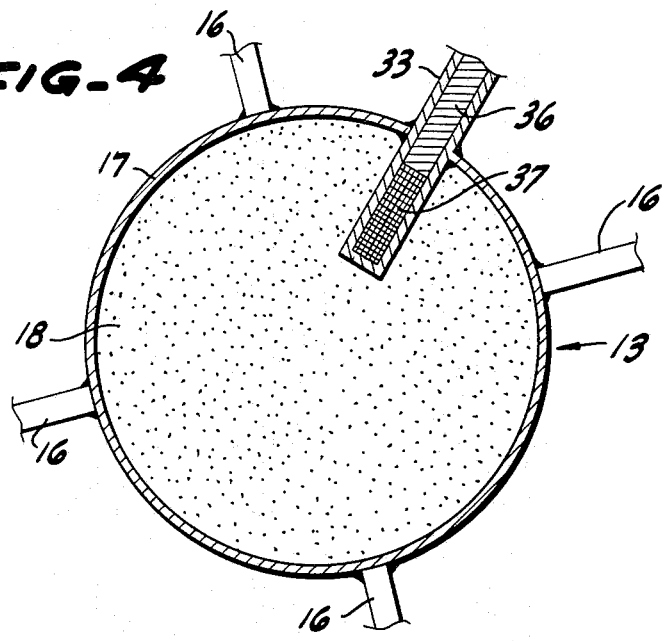

The shock-activated detonator system of FIGS. 1 and 2 and the fuse ignition system of FIGS. 3 and 4 can often be used in combination to advantage in aerial attacks on fires. Should detonator 19 fail to ignite explosive charge 18 upon impact, the fuse ignition system will provide a backup, ensuring ignition and explosive disruption of the fire shortly thereafter.

What is claimed is:

1. An explosive fire extinguishing device comprising:
   a. a spherical, frangible outer shell;
   b. a spherical, frangible inner shell centrally positioned within said outer shell, said inner shell containing an explosive charge;
   c. means for supporting said inner shell in a centrally located position within said outer shell comprising at least one rigid support leg extending between said inner shell and said outer shell;
   d. a fluid medium contained by said outer shell, said fluid medium generally filling the void between said inner shell and said outer shell; and,
   e. means for detonating said explosive charge comprising an open ended cylinder intersecting and positioned within said inner shell, one open end of said cylinder being in communication with said fluid medium, the other open end of said cylinder enclosing a percussion cap extending into said explosive charge, a piston positioned within said cylinder and capable of sliding axially away from said one open end of said cylinder in response to an increase in pressure of said fluid medium, said piston including a firing pin directed toward said other open end of said cylinder and said percussion cap, a removable safety closure member positioned over said one open end of said cylinder, thereby isolating said piston from said fluid medium and preventing said piston from sliding in response to any increase in pressure of said fluid medium, and a connecting member attached to said closure member and extending outside said outer shell enabling selective removal of said closure member from said open end of said cylinder so that said firing pin strikes and actuates said percussion cap in response to an increase in pressure of said fluid medium, said percussion cap thereby detonating said explosive charge and instantaneously creating a substantially spherical cloud of finely divided droplets of fluid.

2. An explosive fire extinguishing device as in claim 1 wherein said fluid medium comprises a solution of water and a fire retardant chemical.

3. An explosive fire extinguishing device as in claim 2 in which the fire retardent chemical is a borate.

* * * * *